US006283769B1

(12) United States Patent
Asao et al.

(10) Patent No.: US 6,283,769 B1
(45) Date of Patent: Sep. 4, 2001

(54) ELECTRIC CONNECTING BOX

(75) Inventors: Takahiro Asao, Yokkaichi; Kazuhiro Aoki, Aichi-ken, both of (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/575,679

(22) Filed: Jun. 28, 2000

(30) Foreign Application Priority Data

Jul. 1, 1999 (JP) ..... 11-187539

(51) Int. Cl.[7] ..... H01R 12/00
(52) U.S. Cl. ..... 439/76.2; 439/74
(58) Field of Search ..... 439/76.2, 76.1, 439/664, 606, 74; 361/826, 852, 804, 752, 753

(56) References Cited

U.S. PATENT DOCUMENTS 4,703,397 * 10/1987 Minoura et al. ..... 361/428

FOREIGN PATENT DOCUMENTS 10178286 6/1998 (JP) .

10189170 7/1998 (JP) .

OTHER PUBLICATIONS

English Language Abstract of JP 10–178286.
English Language Abstract of JP 10–189170.

* cited by examiner

*Primary Examiner*—Gary Paumen
*Assistant Examiner*—Alexander Gilman
(74) *Attorney, Agent, or Firm*—Greenblum & Bernstein, P.L.C.

(57) ABSTRACT

An electric connecting box is provided that has excellent connecting reliability between a printed circuit board and a bus-bar laminated body, and also has the advantage that it is difficult to develop any dead area on the printed circuit board. The electric connecting box includes a bus-bar laminated body including a bus-bar and an insulating base material, a printed circuit board electrically connected therewith, and a connecting block. The connecting block is configured to hold connecting terminals by partially molding a plurality of connecting terminals in a resin insulator block. The first end of each connecting terminal protrudes from the resin insulator block and is soldered with a conductor on one side of the printed circuit board. The second end of each connecting terminal is fixed to a connecting area on a side of the bus-bar laminated body.

23 Claims, 4 Drawing Sheets

ELECTRIC CONNECTING BOX

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Description of Related Art

FIG. 5 shows an example of a conventional electric connecting box 41 mounted in an automobile and the like. The electric connecting box 41 is equipped with a bus-bar laminated body 44, including a bus-bar 42 and an insulation base material 43, and a printed circuit board 45 having the function of an ECU unit. On the upper surface of the printed circuit board 45, various kinds of electronic components are mounted. Terminals of these electronic components are soldered to plated through-holes on the printed circuit board 45. Both ends of the printed circuit board 45 are inserted into first insertion openings 49 of a connector 48 having a plurality of connecting terminals inside 47. A plurality of exposed conductive portions 50 are provided on opposite ends of the printed circuit board 45, such that when the end of the printed circuit board 45 is inserted into the first opening 49, one end of each connecting terminal 47 press contacts the conductive portion 50. On the other hand, at the second insertion opening 51 of the connector 48, a male tab 42*a* formed on the tip of bus-bar 42 is inserted. At the male tab 42*a*, the other end of each connecting terminal 47 press contacts the male tab 42*a*. As a result, the side of the printed circuit board 45 and one of the bus-bar laminated bodies 44 are electrically connected. In this case, an exclusive insulation base material 52 is disposed between the printed circuit board 45 and bus-bar 42 in order to assure insulation between the soldered area on the printed circuit board 45 and the bus-bar 42.

The connector 48 in the conventional electrical connecting box 41 is, however, only held by the pressing force at each connecting terminal 47 for the printed circuit board 45. Therefore, positional displacement is easily brought about for the connector 48, which is liable to impair the connection reliability between the printed circuit board 45 and the bus-bar laminated body 44. In such a case, there may be a possibility that the male tab 42*a* may not be inserted into the second insertion opening 51.

Furthermore, as shown in FIG. 6 in the case of a conventional electric connecting box 41 which uses connectors 48, the exposed conductive portion 50 is totally covered by the connector 48, in addition to the necessity of providing the conductive portion 50 on both ends of the printed circuit board 45. Therefore, a dead area 53 is formed that is occupied by the connector 48, which makes it impossible to form other conductive patterns, thereby causing the problems of making the wiring and component-mounting area smaller on the printed circuit board 45.

The present invention was made in view of the aforementioned problems, and an objective of the present invention is to provide connecting reliability between a printed circuit board and a bus-bar laminated body. In addition, another objective is to provide an electric connecting box that makes it difficult to generate any dead area on a printed circuit board.

2. Field of the Invention

The present invention relates to an electric connecting box housed in, for example, an automobile and the like, and is especially related to a connecting structure between a printed circuit board and a bus-bar laminated body in an electric connecting box.

SUMMARY OF THE INVENTION

In order to solve the aforementioned problems, the present invention includes a bus-bar laminated body formed of a bus-bar and a insulation material, and a printed circuit board electrically connected with the bus-bar laminated body.

A connecting block is provided having a construction including a plurality of connecting terminals partially molded in a resin block, and that holds the connecting terminals relative to each other. A first end of each connecting terminal which projects from the resin block is soldered to a connector on one side of the printed circuit board, and a second end of each connecting terminal is fixed to a connecting area on the side of the aforementioned bus-bar laminated body.

The electric connection box of the present invention may also include a supporting face of the resin block that supports a surface of the printed circuit board in a non-bonded state, which surface mounts components of the printed circuit board.

The electric connecting box of the present invention may further include a connecting area of the bus-bar laminated body side formed to house a female connector, such as a relay terminal in a connector housing provided to extend upwardly from the insulated base material. A second end of each connecting terminal is then inserted into an opening area of the relay terminal.

Description follows of the function of the present invention. According to one aspect of the present invention, the first end of each connecting terminal is firmly fixed by soldering to a side of printed circuit board. Therefore, it is difficult to cause any positional displacement of the connecting block is unlikely, thereby preventing a reduction of the connecting reliability from occurring between the printed circuit board and the bus-bar laminated body. Furthermore, the use of such a connecting block makes it unnecessary to form an exclusive pad for connection, thereby avoiding a dead area on the printing circuit board.

According to another aspect of the present invention, the component-mounting surface of the printed circuit board is held by a holding surface of a resin block to positively position the printed circuit board at a predetermined height position. In addition, because the holding surface and the component-mounting surface are provided in a non-bonded condition, it is also possible to form a pattern at the position where the printed circuit board is held by the resin block.

In another aspect of the present invention, inserting the second end of the connecting terminals into the opening area of a relay terminal can fix the printed circuit board to the bus-bar laminated body by allowing the female connector to be electrically connected with the printed circuit board through respective connecting terminals on the connecting block. Furthermore, because the connector housing is provided to protrude from the insulation base material, it is relatively easy to secure a mounting height of the printed circuit board, thereby making the space between the bus-bar laminated body and the printed circuit board relatively larger than previously possible. In addition, a structure using a relay terminal makes it possible to insert and withdraw the second end of each connecting terminal into and from the female connector.

According to another aspect of the present invention, an electric connecting box is provided that includes an outer case, and a printed circuit board and a laminated bus-bar body mounted within the outer case. The electric connecting box includes a connection block electrically connecting the printed circuit board to the bus-bar body and spacing the printed circuit board a predetermined distance above the bus-bar to permit mounting of various electronic components to the printed circuit board on a side facing the bus-bar. The connection block is configured separately from the printed circuit board and the bus-bar body.

In a further aspect of the present invention, the connection block may include an insulator block and at least one connecting terminal partially embedded in the insulator block. Furthermore, a first end of the at least one connecting terminal may protrude from a side of the insulator block and form the electrical connection to the printed circuit board, a second end of the at least one connecting terminal may protrude from a lower surface of the insulator block and form the electrical connection with the bus-bar, and an upper surface of the insulator blocks directly engages the printed circuit board.

According to another aspect of the present invention, the engagement between the upper surface of the insulator block and the printed circuit board is free of any direct securement. Additionally, the bus-bar may include an upper insulation lamination provided with at least one upwardly extending connection housing having at least one female connector mounted therein configured to receive the second end of the at least one connecting terminal. Also, the female connector may be further configured to receive a tab extending upwardly from a bus-bar of the bus-bar body.

In other aspects of the present invention, the at least one connector housing may further include at lease one guide post extending upwardly from an upper surface thereof, the guide post including an angled surface to receive and guide the insulator block and the printed circuit board during insertion of the second end of the at least one connecting terminal into the at least one female connector. Additionally, the invention may also include a pair of the guide posts on opposite ends of the at least one connector housing, at least a pair of the connector housings, and the insulator block may be formed of a resin material. Furthermore, the insulator block may include misalignment prevention holes positioned between adjacent connecting terminals to prevent the flow of resin therebetween, thereby preventing misalignment of the connecting terminals during molding.

In another aspect of the present invention, the printed circuit board may include at least one protrusion, and the other of the upper surface and the printed circuit board may include at least one corresponding recess having a complementary size and shape to that of the at least one protrusion, so that the at least one protrusion engages within the at least one corresponding recess to prevent lateral displacement between the insulator block and the circuit board.

In a further aspect of the present invention, a method of assembling an electric connecting box having a casing is provided. The method includes providing a printed circuit board, providing at least one connecting block including a plurality of connecting terminals partially embedded in an insulator block, positioning an upper surface of the insulator block in direct, unsecured, engagement with the printed circuit board and attaching a first end of each connecting terminal to a respective circuit of the printed circuit board. The method further includes providing a laminated bus-bar including at least one connector housing containing a plurality of female connectors therein, and then inserting a second end of each connecting terminal into a respective female connector to thereby electrically connect the printed circuit board to the bus-bar body and to space the printed circuit board a predetermined distance above the bus-bar body.

According to another aspect of the present invention, the method may also include providing a pair of upwardly extending guide posts on opposite ends of the at least one connector housing, each the guide post having angled surfaces, and guiding the insulator block and the printed circuit board along the angled surfaces during the insertion to provide easy insertion of the second ends into the female connectors.

In further aspects of the present invention, the method may include providing the first end of the connecting terminal with a portion formed at a right angle to a remaining portion of the first end, and positioning an electrical component on the printed circuit board at a location between the insulator block and the attaching point for the first end of at least one connecting terminal.

DETAILED DESCRIPTION OF THE PREFERRED EMBODIMENTS

Detailed description follows of the embodiments of the present invention with regard to an electric connection box 1 to be used for mounting in an automobile, with reference to FIG. 1 to FIG. 4 of the drawings.

Figure 1:
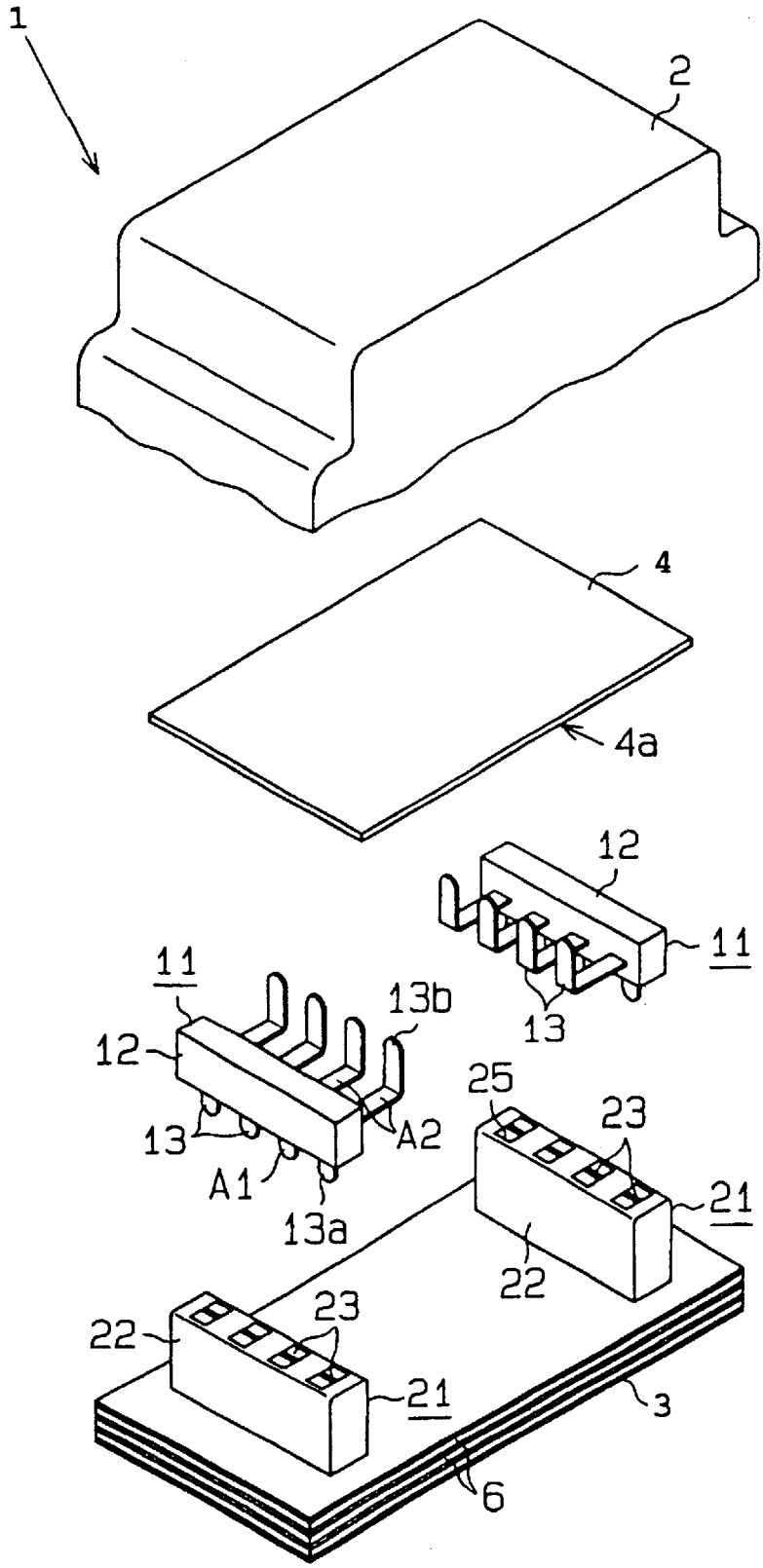
FIG. 1 is a schematic exploded perspective view showing one embodiment of the electric connection box of the present invention.
Figure 2:
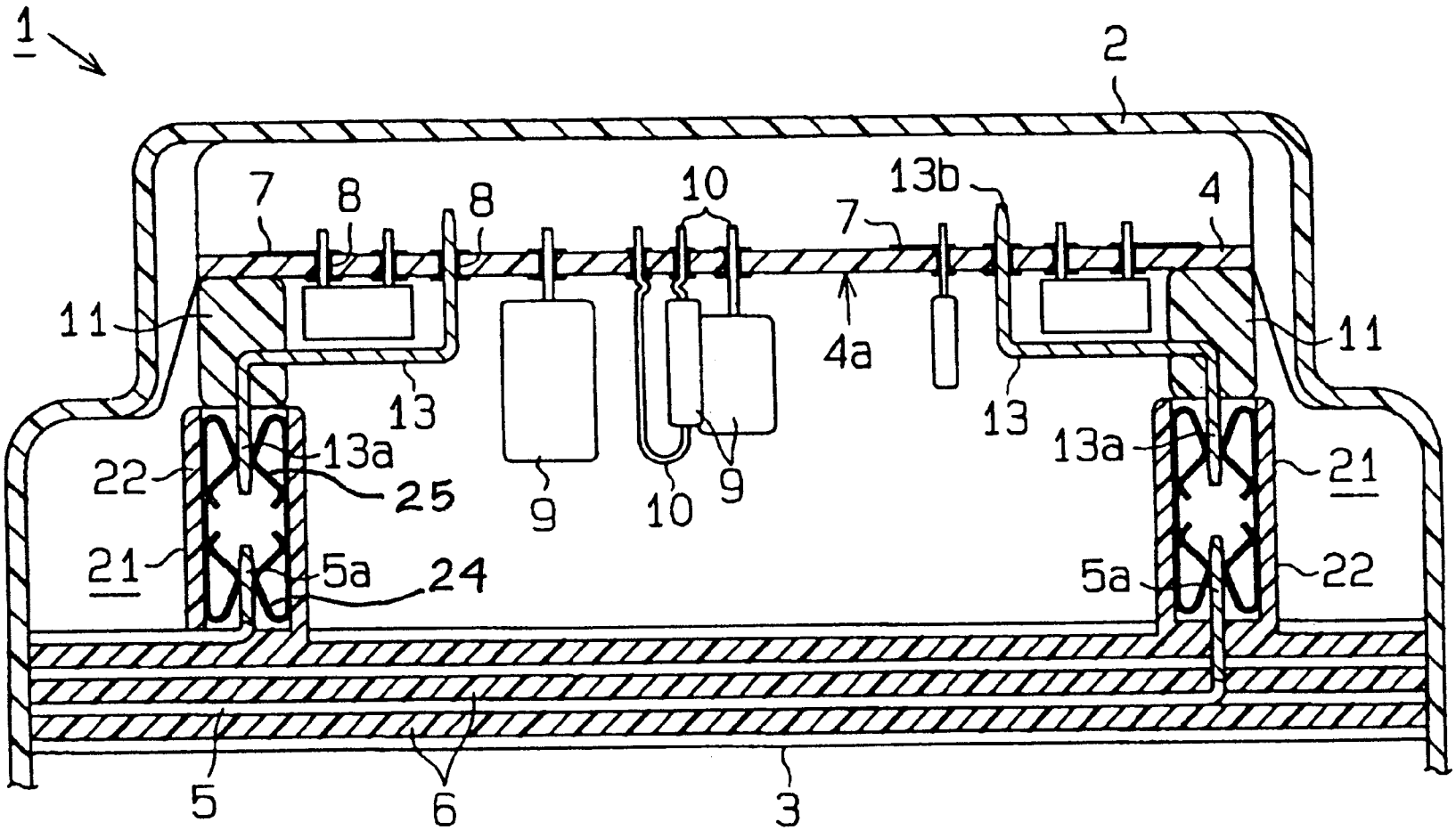
FIG. 2 is a cross-sectional view of the embodiment of the electric connection box of FIG. 1.

As shown in FIGS. 1 and 2, a bus-bar laminated body 3 and a printed circuit board 4 which provides the function of an ECU unit, are mounted in a resin case 2 which forms the electric connection box 1.

The bus-bar laminated body 3 of the present embodiment is constructed to have a generally rectangular form overall, and includes an arrangement alternately laminated with a bus-bar 5 formed of a suitable conductive metal plate and an insulation base material 6 formed of a suitable insulating material, for example, a resin. The bus-bar laminated body 3 is arranged near an opening area of the case 2.

The printed circuit board 4 has a generally rectangular form which is made smaller in size than the bus-bar laminated body 3. The printed circuit board 4 of the present invention is a two-side plate having a conductive pattern 7 on both sides of the base material. The conductive patterns 7 located on both sides of the printed circuit board 4 are mutually disposed to be conductive through plated through-holes 8 which allow insertion of pins. In FIGS. 1 and 2, various electronic components 9 (such as an IC package, a resistor, a condenser, etc.) are mounted on one side 4*a* (i.e., components-mounted side) of the printed circuit board 4. Any of the electronic components 9 has a plurality of terminals 10, each terminal being inserted into a corresponding plated through-hole 8 and soldered.

Description follows of a connecting structure between the printed circuit board 4 and the bus-bar laminated body 3. In this electric connection box 1, electric connection is established between the printed circuit board 4 and the bus-bar laminated body 3 by connecting a connecting block 11, which is provided on a side of printed circuit board 4, with a connector 21, which is provided on a side of the bus-bar laminated body 3. In the present embodiment, two connecting blocks 11 are used in the electric connecting box 1. The two connecting blocks 11 are arranged at two spaced apart positions on the component-mounting surface 4*a* of the printed circuit board 4.

Figure 3:
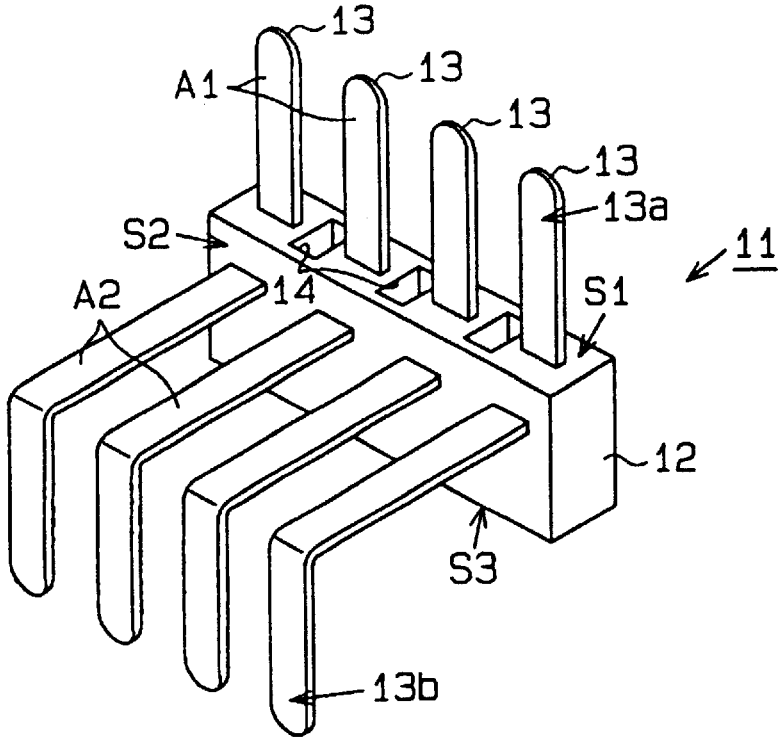
FIG. 3 is a perspective view showing a connecting block to be used in the electric connecting box of FIG. 1.

As shown in FIG. 3, the connecting block 11 has a construction in which a plurality (four in number in the present case) of connecting terminals 13 are partially molded in an insulator block 12, which may be, for example, a resin. In this case, for case of understanding the drawing, the connecting block 11 is depicted upside-down. The insulator block 12 has a thin rectangular form, and is formed of any suitable material, such as a resin molded material, for example, epoxy resin, etc., having insulation resistance and heat resistance. As shown in FIG. 2, the lower surface S3 of resin block 12 contacts the component-mounting surface 4*a* of the printed circuit board 4. However, the lower surface S3 and the component-mounting surface 4*a* are not bonded in any manner, such as by the use of adhesive, etc. Thus, it should be understood that the component-mounting surface 4*a* is held by a lower surface (holding surface) S3 of the insulator block 12 in a non-bonded condition. However, the lower surface S3 may be provided with at least one projection having any desired cross-sectional shape, for example circular, and the component-mounting surface 4*a* would then be provided with a corresponding number of complementary sized and shaped recesses to receive the at least one projection to prevent lateral displacement between the resin block 12 and the printed circuit board. Alternatively, the at least one projection may be formed on the circuit board and the corresponding complementary recesses formed on the surface S3 of the insulator block.

The connecting terminals 13 are formed of a suitable flat plate-shaped conductive metal material in substantially the same manner as the bus-bar in the present embodiment. The connecting terminals 13 are held mutually parallel at the same intervals by being molded in the insulator block 12 through, for example, insert-molding. The lower arm A1 (FIG. 2) of each connecting terminal 13 is linearly formed, and protrudes vertically from the lower surface S1 of the insulator block 12. On the other hand, the upper arm area A2 of each connecting terminal 13 is bent vertically at generally a right angle after protruding from one side surface S2 of the resin block 12. The second end 13*b* of the upper arm area A2 is arranged in an upward direction relative to the insulator block 12 (FIG. 2). At the region between each connection terminal 13, a plurality of misalignment prevention holes 14 are formed by mold elements during the molding process to prevent the flow of resin between adjacent connection terminals 13 to prevent misalignment of the connection terminals 13 during the molding process. The misalignment prevention holes may be formed as non-through holes of generally rectangular cross-section. In the present embodiment, the portion of each connecting terminal molded into the insulator block 12 is also formed at a right angle.

As shown in FIG. 2, the second end 13*b* of the upper arm area A2 of each connecting terminal 13 is inserted into a plated through-hole 8 on the side of printed circuit board 4 and is soldered. That is, the second end 13*b* is inserted into the plated through-hole 8 from the same direction as the connecting terminal 10 of other electronic components 9. The first end 13*a* of the lower arm area A1 of each connecting terminal 13 is fixed by being inserted into the connector 21 on bus-bar laminated body 3.

Figure 4:
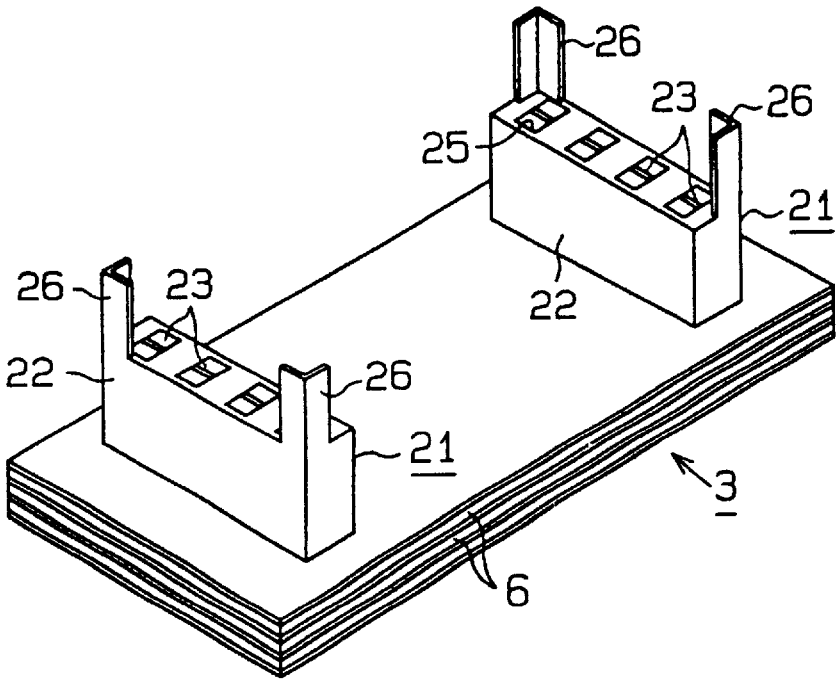
FIG. 4 is a perspective view showing a bus-bar laminated body.
Figure 5:
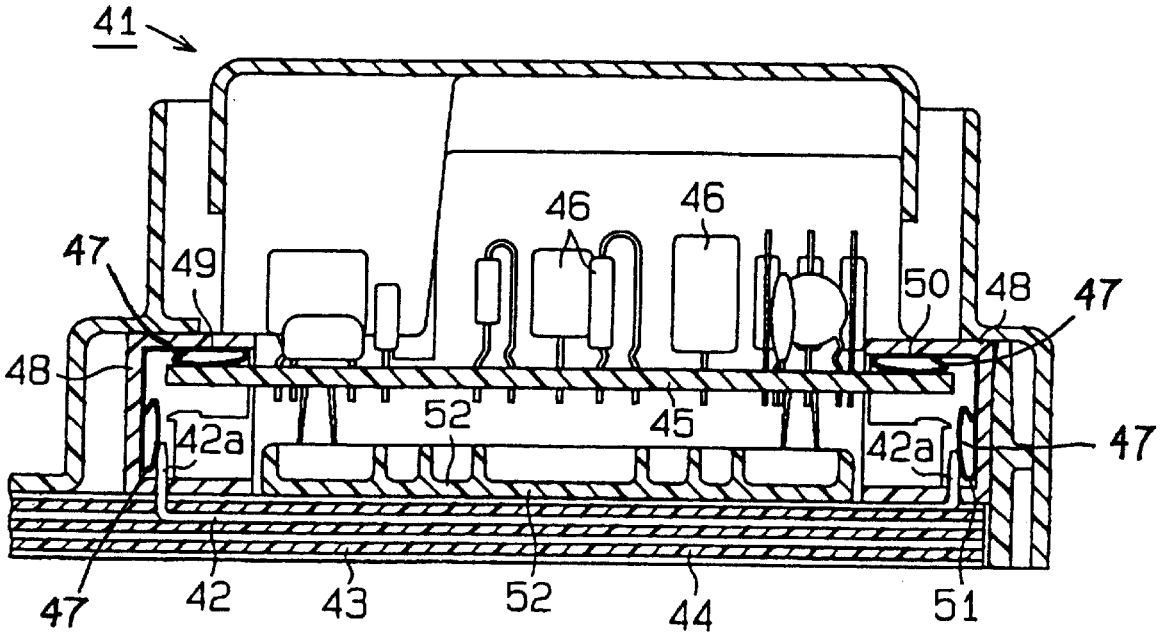
FIG. 5 (PRIOR ART)
FIG. 5 is a cross-sectional view showing the conventional electric connection box.
Figure 6:
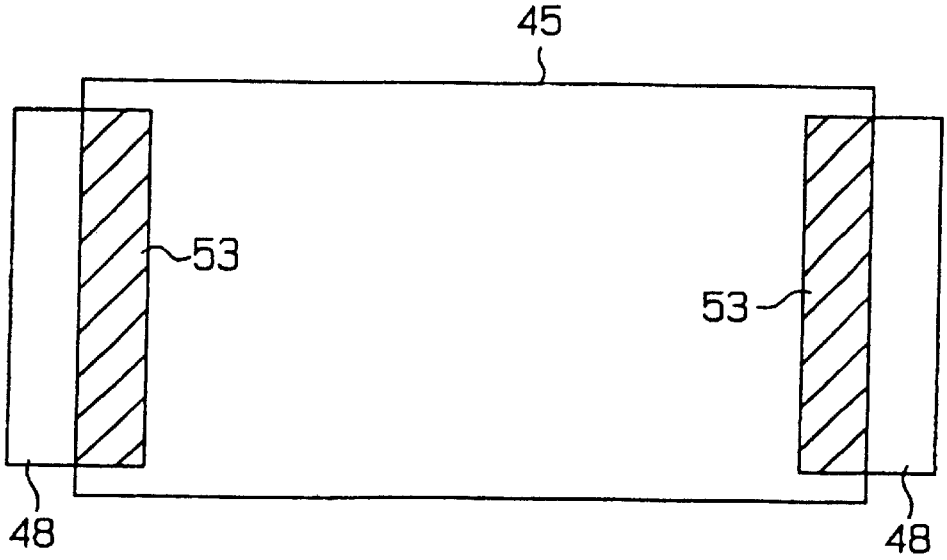
FIG. 6 (PRIOR ART)
FIG. 6 is a schematic plan viewing showing a printed circuit board and a connector for the conventional electric connection box.

As shown in FIG. 4, the bus-bar laminated body 3 is equipped with female connectors 21 as connecting areas disposed at two spaced apart positions. More particularly, the female connectors 21 extend upwardly at the positions corresponding to the two connecting blocks 11 located on the printed circuit board 3.

A connector housing 22 which forms the female connectors 21 is formed unitarily and in one piece with the top layer of insulation base material 6 forms the bus-bar laminated body 3. In each connector housing, a plurality (four in number in this case) of tubular relay terminals 23 formed of conductive metal material are housed.

One opening area 24 in the relay terminal 23 is arranged in a downward direction, while the other opening area 25 is arranged in an upward direction. In the opening area 24 at the lower side, a male tab 5*a* provided on the tip of bus-bar 5 is inserted and fixed. Consequently, a part of relay terminal 23 makes pressure contact with the side face of male tab 5*a*, so that the male connector 21 and the bus-bar 5 electrically connect. The upper opening area 25, exposed on the upper end face of the connector housing 22, is brought into alignment with the connecting terminal 13 at the same pitch. For these upper openings areas 25, the first end 13*a* of each connecting terminal 13 is configured to permit insertion and withdrawal.

As shown in FIG. 2, when the first end 13*a* is inserted and fixed in the upper opening area 25, a part of relay terminal 23 makes pressure contact with the side surfaces of the first end 13*a*, consequently allowing electrical connection between the female connector 21 and the connecting terminal 13.

As shown in FIG. 4, a guide post 26 is protrudes upwardly from each upper end face of connector housing 22 to serve as a guide structure when mounting the printed circuit board 4. Thus, guide posts 26 are provided on each connector housing 22. The guide posts 26 are located at two corner areas on each upper end face, namely, at positions apart each other on the upper end face. The guide posts 26 of the present embodiment are formed to have sectional configuration generally L-shaped cross-sectional configuration, thus providing an angled area inside of each post which guides the edge of printed circuit board 4 during insertion. In this case, the guide posts 26 are formed unitarily and in one piece with the connector housing 22.

The assembly of the electric connection box 1 in the present embodiment is carried out in the following manner. First, a printed circuit board 4 is prepared, and each electronic component 9 and connecting block 11 is mounted on the component-mounting surface 4*a*. In such a case, each terminal 10 and connecting terminal 13 are inserted into corresponding plated through-holes 8, then terminals 10 and connecting terminals 13 in the plated through-holes 8 are connected to the printed the circuit board by soldering. Then, the aforementioned printed circuit board 4, which was subjected to the soldering process, is positioned upside down with the component-mounting side extending downwardly. Under this condition, the printed circuit board 4 is brought toward the bus-bar laminated body 3, followed by positioning at a region where the female connectors 21 are provided. Then, the printed circuit board 4 is vertically lowered, followed by mating of the printed circuit board 4 between respective guide posts 26. In this case, the printed circuit board 4 is guided by sliding on the angle surfaces of the guide posts 26. When the lower face S1 of insulator block 12 contacts the upper face of connector housing 22, the lower surface S1 is held by the upper surface of the connector housing 22. Consequently, the printed circuit board 4 is held in a horizontal at a predetermined height. In the present embodiment, between the printed circuit board and the bus-bar laminated body 3, an interval greater than the height of electronic components 9, 10 is normally provided.

In addition, when press-fitting the printed circuit board 4, the first end 13*a* of the lower arm area A1 of each connecting terminal 13 is inserted into and fixed with respect to the corresponding female connector 21. As a result, the sides of printed circuit board 4 and bus-bar laminated body 3 are electrically connected through the connecting block 11. Then, by housing the module formed by the printed circuit board 4 and the bus-bar laminated body 3 in the case 2, the desired electric connection box 1, as shown in FIG. 1, can be completed.

Therefore, the following results can be achieved with the use of the present embodiment:

(1) With the electric connecting box 1 of the present invention, the second end 13*b* of each connecting terminal 13 is positively connected by soldering at the respective plated through-holes 8 of the printed circuit board 4. Therefore, any positional displacement at each connecting terminal 13 is unlikely compared with the conventional electrical connecting box, thereby making it possible to prevent reduction of the connecting reliability between the printed circuit board 4 and bus-bar laminated body 3. Consequently, an electric connection box having higher reliability can be realized.

Furthermore, with the electric connecting box 1 using the connecting block 11 of the aforementioned structure, it is no longer necessary to form an exclusive connecting pad on the printed circuit board 4. This being the case, larger areas for wiring and component-mounting compared to those of the conventional type can be assured, thus further improving the area utilization rate of the printed circuit board 4.

(2) With the electric connecting box 1 of the present invention, holding the printed circuit board 4 on the upper surface S3 of insulator block 12, the printed circuit board 4 can positively be held at a predetermined height position. Furthermore, the upper surface S3 and the component-mounting surface 4*a* of the printed circuit board 4 are disposed in a non-bonded condition, and, thereby pattern formation at the non-bonded position of the printed circuit board 4 is made possible. Therefore, it is difficult to develop a dead area on the corresponding mounting area thus positively increasing the area utilization rate on the printed circuit board 4.

(3) Furthermore, the connector housing 22 is provided on the insulation base material 6 to protrude therefrom, which makes obtaining the mounting height of the printed circuit board 4 comparatively easy. Therefore, comparatively greater space is obtainable between the bus-bar laminated body 3 and the printed circuit board 4. Thus, in order to avoid possible shorting of electronic components 9, it is not necessary to provide an exclusive insulating board on the top layer of the bus-bar laminated body 3, thereby making it possible to avoid an increase in the number of components as well as further complication of the system.

(4) Furthermore, since the female connector 21 is configured to house the relay terminals 23, insertion and withdrawal of the first end 13*a* of the female connector 21 is made possible. Therefore, easy mounting and removal of the printed circuit board 4 is made possible if desired, thus rendering an exchange of the printed circuit board a simple operation.

The above disclosed embodiment of the present invention may be modified in the following manner.

It may be possible not only to mount the components on the mounting surface 4*a* of printed circuit board 4 in a downward direction (so-called, face-down) as in the above described embodiment, but also to mount the component-mounting surface 4*a* in an upward direction (so-called, face-up). That is, connecting block 11 may be mounted on the non-component mounting surface of the printed circuit board 4.

The printed circuit board 4 may not only be confined to the function of an ECU unit, but may also have another function.

The female connector housing 22 on the side of bus-bar laminated body 3 may not always be unitarily molded with the insulation base material 6. That is, the connector housing 22 may be molded as a separate body and be joined with the insulation material 6 in any suitable manner, as for example, by adhesive.

The terminals 10 of electronic components 9 and the connecting terminals 13 of connecting block 11 may not always be inserted into and soldered to the inside of plated through-holes 8. For example, pads may be provided on the printed circuit board 4, and the terminals 10 and connecting terminals 13 may be soldered therewith in a surface mounting system.

The plate-like configuration of the connecting terminals 13 which are molded into the insulator block 12 need not be confined to such an embodiment, but may also have, for example, a bar form. In addition, the number of connecting terminals 13 molded in one insulator block 12 may be increased or decreased.

The female connector 21 may be arranged at three or more positions, each separated on the insulation base material 6.

A terminal structure different from the relay terminal 23 of the present embodiment may be adopted as the conductor housed in female connector 21. In addition, so long as the structure enables the first end 13*a* of each connecting terminal 13 to be fixed, the use of any alternative to the female connector 21 of the present embodiment may be allowed as a connecting area of the side of the bus-bar laminated body.

Further technical concepts to be realized by the aforementioned embodiment are enumerated together with the effects below:

(1) In one aspect of the present invention, the connector housing is unitarily formed with the insulation base material on the top layer which forms the bus-bar laminated body. Therefore, according to this aspect of the invention as set forth in this technical concept 1, the number of assembly processes can be reduced and the number of components decreased.

(2) In another aspect of the present invention, the connector housings are provided at a plurality of spaced positions. Therefore, according to the invention as set forth in this technical concept 2, a horizontal and safe condition can be maintained at a predetermined height even when a large printed circuit board is used.

(3) In a further aspect of the present invention, a guide structure is provided on the upper surface of the connector housing to mount the printed circuit board. Therefore, according to the invention as set forth in this technical concept 3, mounting of printed circuit board onto the female connector becomes easier.

(4) In still another aspect of the present invention, the guiding structure is a guide post which projects from the upper surface of the connector housing, and the post has an angled surface which guides an end of the printed circuit board. Therefore, according to the invention as set forth in the present technical concept 4, the mounting of the printed circuit board to the female connector becomes even easier.

(5) In yet another aspect of the present invention, a conductor of the printed circuit board is formed as a plated through-hole and a first end of each connecting terminal is inserted into a respective plated through-hole from the same direction as a connecting terminal of an other electronic component, and is soldered to the plated through-hole after insertion. Therefore, according to the invention as set forth in this technical concept 5, an increase in the number of soldering operations of components to the printed circuit board can be avoided.

(6) In a still further aspect of the present invention, the printed circuit board is mounted on the bus-bar laminated body so that the component-mounting surface is directed toward the bus-bar laminated body side. Therefore, according to the invention as set forth in this technical concept 6, an increase in the number of soldering operations of components to the printed circuit board can be avoided.

As mentioned above in detail, an object of the present invention is to provide an electric connecting box which ensures excellent connecting reliability between a printed circuit board and a bus-bar lamination body, and which makes it difficult an to provide a possible dead area of the printed circuit board.

Additionally, a dead area is much less likely to be formed on the printed circuit board, thereby positively improving the area utilization rate of the printed circuit board. Moreover, there would be no need for providing an exclusive insulation board on the upper layer of the bus-bar lamination body, thus avoiding the possible increase in the number of components involved and complexity of the structure.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. JP 11-1 87539, filed on Jul. 1, 1999, which is expressly incorporated herein by reference in its entirety.

Deposit of Computer Program Listings not applicable

What is claimed is:

1. An electric connecting box including a bus-bar laminated body formed of bus bars and an insulation material, and a printed circuit board electrically connected with the bus-bar laminated body, said electric connecting box further comprising:

a connecting block comprising an insulator block, said insulator block configured to have a plurality of connecting terminals partially embedded therein, such that said connecting terminals are fixedly positioned with respect to each other;

a first end of each said connecting terminal protrudes from said insulator block and is soldered to a connector on a side of said printed circuit board; and a second end of each said connecting terminal is fixed to a corresponding connecting area on a side of said bus-bar laminated body.

2. The electric connecting box as set forth in claim 1, wherein a supporting face of said insulator block engages and supports a surface of said printed circuit board in a non-bonded condition adjacent a component on said printed circuit board.

3. The electric connecting box as set forth in claim 1, wherein a connecting area of said bus-bar laminated body side is formed as a female connector having a configuration that houses a relay terminal in a connector housing extending upwardly from said insulated base material, and said second end of each said connecting terminal is insertably fixed within an opening of said relay terminal.

4. The electric connecting box as set forth in claim 1, wherein said connecting terminals are partially embedded by molding a portion thereof within said insulator block.

5. The electric connecting box as set forth in claim 4, wherein said insulator block comprises a resin material.

6. The electric connecting box as set forth in claim 1, wherein said insulator block comprises a resin material.

7. An electric connecting box including an outer case, and a printed circuit board and a laminated bus-bar body mounted within said outer case, said bus-bar body including at least one upwardly extending connection housing, said electric connecting box comprising:

a connection block superposed on said upwardly extending connection housing and electrically connecting said printed circuit board to said bus-bar body and spacing said printed circuit board a predetermined distance above said bus-bar to permit mounting of various electronic components to said printed circuit board on a side facing said bus-bar, said connection block configured separately from said printed circuit board and said bus-bar body.

8. The electric connecting box as set forth in claim 7, wherein said connection block comprises an insulator block and at least one connecting terminal partially embedded in said insulator block.

9. The electric connecting box as set forth in claim 8, wherein a first end of said at least one connecting terminal protrudes from a side of said insulator block and forms the electrical connection to said printed circuit board at a location spaced from said insulator block, a second end of said at least one connecting terminal protrudes from a lower surface of said insulator block and forms the electrical connection with said bus-bar, and an upper surface of said insulator blocks directly engages said printed circuit board.

10. The electric connecting box as set forth in claim 9, wherein the engagement between said upper surface of said insulator block and said printed circuit board is free of any direct securement.

11. The electric connecting box as set forth in claim 9, wherein said bus-bar includes an upper insulation lamination provided with at least one upwardly extending connection housing having at least one female connector mounted therein configured to receive said second end of said at least one connecting terminal.

12. The electric connecting box as set forth in claim 11, wherein said female connector is further configured to receive a tab extending upwardly from a bus-bar of said bus-bar body.

13. The electric connecting box as set forth in claim 11, wherein said at least one connector housing further comprises at lease one guide post extending upwardly from an upper surface thereof, said guide post including an angled surface to receive and guide said insulator block and said printed circuit board during insertion of said second end of said at least one connecting terminal into said at least one female connector.

14. The electric connecting box as set forth in claim 13, further comprising a pair of said guide posts on opposite ends of said at least one connector housing.

15. The electric connecting box as set forth in claim 14, further comprising at least a pair of said connector housings.

16. The electric connecting box as set forth in claim 8, wherein said insulator block comprises a resin material.

17. The electric connecting box as set forth in claim 16, wherein said insulator block includes misalignment prevention holes positioned between adjacent connecting terminals to prevent the flow of resin therebetween, thereby preventing misalignment of said connecting terminals during molding.

18. The electric connecting box as set forth in claim 10, wherein one of said upper surface and said printed circuit board includes at least one protrusion, and the other of said upper surface and said printed circuit board includes at least one corresponding recess having a complementary size and shape to that of said at least one protrusion, so that said at least one protrusion engages within said at least one corresponding recess to prevent lateral displacement between said insulator block and said circuit board.

19. A method of assembling an electric connecting box having a casing comprising:

providing a printed circuit board;

providing at least one connecting block comprising an insulator block, said insulator block including a plurality of connecting terminals partially embedded therein;

positioning an upper surface of said insulator block in direct, unsecured, engagement with said printed circuit board and attaching a first end of each connecting terminal to a respective circuit of said printed circuit board;

providing a laminated bus-bar including at least one connector housing containing a plurality of female connectors therein; and then inserting a second end of each connecting terminal into a respective female connector to thereby electrically connect said printed circuit board to said bus-bar body and to space said printed circuit board a predetermined distance above said bus-bar body.

20. The method according to claim 19, further comprising providing a pair of upwardly extending guide posts on opposite ends of said at least one connector housing, each said guide post having angled surfaces, and guiding said insulator block and said printed circuit board along said angled surfaces during said insertion to provide easy insertion of said second ends into said female connectors.

21. The method according to claim 19, further comprising providing said first end of said connecting terminal with a portion formed at a right angle to a remaining portion of said first end.

22. The method according to claim 21, further comprising positioning an electrical component on said printed circuit board at a location between said insulator block and an attaching point for said first end of at least one connecting terminal.

23. The electric connecting box as set forth in claim 8, wherein a first end of said at least one connecting terminal protrudes from a side of said insulator block and forms the electrical connection to said printed circuit board at a location spaced from said insulator block, and wherein said insulator block spaces a portion of said terminal from said printed circuit board to provide a space between said printed circuit board and said terminal to receive an electrical component mountable in said space.

* * * * *